US011631311B2

(12) United States Patent
Song et al.

(10) Patent No.: US 11,631,311 B2
(45) Date of Patent: Apr. 18, 2023

(54) WEARABLE ELECTRIC SHOCK RECOGNITION DEVICE

(71) Applicant: SN CO., LTD, Daejeon (KR)

(72) Inventors: Soo Joon Song, Daejeon (KR); Dae Sung Yoo, Cheongju-si (KR); Jeong Min Lee, Daejeon (KR); Ji Hyeon Kim, Daejeon (KR)

(73) Assignee: SN Co., Ltd, Daejeon (KR)

( * ) Notice: Subject to any disclaimer, the term of this patent is extended or adjusted under 35 U.S.C. 154(b) by 304 days.

(21) Appl. No.: 17/056,158

(22) PCT Filed: Nov. 5, 2020

(86) PCT No.: PCT/KR2020/015357

§ 371 (c)(1),
(2) Date: Nov. 17, 2020

(87) PCT Pub. No.: WO2022/097770

PCT Pub. Date: May 12, 2022

(65) Prior Publication Data

US 2022/0309895 A1 Sep. 29, 2022

(30) Foreign Application Priority Data

Nov. 4, 2020 (KR) ..... 10-2020-0145727

(51) Int. Cl.

| | |
|---|---|
| ***G08B 21/02*** | (2006.01) |
| ***G06Q 50/10*** | (2012.01) |
| ***G08B 21/18*** | (2006.01) |

(52) U.S. Cl.
CPC ..... *G08B 21/02* (2013.01); *G06Q 50/10* (2013.01); *G08B 21/182* (2013.01)

(58) Field of Classification Search
CPC ..... G08B 21/02; G08B 21/182; G06Q 50/10; G01R 31/52; G01R 19/16566; G01R 27/02; G01R 27/2629
See application file for complete search history.

(56) References Cited

U.S. PATENT DOCUMENTS

| | | | | |
|---|---|---|---|---|
| 7,064,558 | B1 * | 6/2006 | Bentley | G01R 33/09 324/610 |
| 9,978,239 | B2 * | 5/2018 | Song | G06Q 50/10 |
| 2008/0231294 | A1 * | 9/2008 | You | G01N 27/02 324/725 |
| 2017/0263097 | A1 | 9/2017 | Song et al. | |
| 2018/0259561 | A1 * | 9/2018 | Park | G01R 33/0206 |

* cited by examiner

*Primary Examiner* — Curtis A Kuntz
*Assistant Examiner* — James E Munion
(74) *Attorney, Agent, or Firm* — Paratus Law Group, PLLC

(57) ABSTRACT

Disclosed is a wearable electric shock recognition device, which includes first to fourth variable resistors and a bridge resistor forming a bridge circuit; a resistance compensator compensating the first to fourth variable resistors in the bridge circuit so that the bridge circuit is in a balanced state. When it is determined that a magnitude of a current flowing through a bridge line exceeds a predetermined electric shock threshold, a determiner determines that an electric shock event has occurred.

2 Claims, 6 Drawing Sheets

| human body resistance | R1 | R2 | R3 | R4 |
|---|---|---|---|---|
| | 50 | 100 | 40 | 10 |

| variable resistor | 112 | 122 | 132 | 142 |
|---|---|---|---|---|
| | 150 | 100 | 160 | 190 |

| | | | | |
|---|---|---|---|---|
| 10 | 50 | 100 | 40 | 10 |
| 5 | 5 | 10 | 4 | 1 |
| 2 | 1 | 2 | 4 | 1 |
| | 1 | 1 | 2 | 1 |

10 x 5 x 2 x 1 x 1 x 2 x 1 = 200

WEARABLE ELECTRIC SHOCK RECOGNITION DEVICE

CROSS-REFERENCE TO PRIOR APPLICATIONS

This application is a National Stage Patent Application of PCT International Patent Application No. PCT/KR2020/015357 (filed on Nov. 5, 2020) under 35 U.S.C. § 371, which claims priority to Korean Patent Application No. 10-2020-0145727 (filed on Nov. 4, 2020), which are all hereby incorporated by reference in their entirety.

BACKGROUND

The present invention relates to a wearable electric shock recognition device and, more specifically, to a wearable electric shock recognition device configured to be capable of determining whether an electric shock has occurred on the basis of an output of a sensor worn on a human body.

Various technologies have been proposed to prevent electric shock accidents.

For example, there is a technology that alerts an operator by generating an alarm when the operator is too close to various electric devices or buses without implementing safety rules. However, the degree of electric shock may depend on the operator even in the situation where the surrounding high voltage is the same. For example, even when the detector does not provide the alarm, it is likely that some workers may be electrically shocked.

Therefore, it is necessary to determine whether or not the electric shock has occurred for each worker.

In this regard, the applicant has disclosed U.S. Patent Publication No. 2017-0263097 titled "SYSTEM WITH WEARABLE DEVICE FOR ALERTING ELECTRIC SHOCK, RELATED DISTRIBUTING BOARD".

However, even when an operator wears a wearable electric shock warning device, it may erroneously determine as to whether an electric shock has occurred under certain circumstances.

Referring to FIG. 1, it can be seen that the operator wears a wearable electric shock warning device 10 on his/her left arm LH. However, when the wearable electric shock warning device 10 is worn on the left arm at the opposite side of the high voltage source, the wearable electric shock warning device 10 may not be able to detect an increase in biocurrent due to the high voltage source. This is because most of biocurrent increased by the high voltage source is discharged to the ground through right arm, torso, and right feet of the operator in sequence, as shown in FIG. 1.

SUMMARY

The present invention has been made to solve the above-mentioned problems, and an objective of the present invention is to provide a wearable electric shock recognition device configured to be capable of accurately determining whether an electric shock has occurred regardless of whether a wearer wears the wearable electric shock recognition device in the direction of the high voltage source and what posture the wearer takes.

A wearable electric shock recognition device according to a preferable embodiment of the present invention includes first to fourth variable resistors 112, 122, 132, and 142 and a bridge resistor 150 forming a bridge circuit 1000; a resistance compensator 210 compensating the first to fourth variable resistors 112, 122, 132, and 142 in the bridge circuit 1000 so that the bridge circuit 1000 is in a balanced state; and when it is determined that a magnitude of a current i flowing through a bridge line BL exceeds a predetermined electric shock threshold, a determiner 230 determines that an electric shock event has occurred.

Herein, the first to fourth variable resistors 112, 122, 132, and 142 may be digital variable resistors.

In addition, the resistance compensator 210 may collect first to fourth human body resistance values R1, R2, R3, and R4 measured by the first to fourth resistance measurer 111, 121, 131, and 141, the resistance compensator 210 may control the first variable resistor 112 so that an equivalent resistance value of the first body resistance value R1 and the first variable resistor 112 becomes the least common multiple of the first to fourth human body resistance values R1, R2, R3, and R4, the resistance compensator 210 may control the second variable resistor 122 so that an equivalent resistance value of the second body resistance value R2 and the second variable resistor 122 becomes the least common multiple of the first to fourth human body resistance values R1, R2, R3, and R4, the resistance compensator 210 may control the third variable resistor 132 so that an equivalent resistance value of the third body resistance value R3 and the third variable resistor 132 becomes the least common multiple of the first to fourth human body resistance values R1, R2, R3, and R4, and the resistance compensator 210 may control the fourth variable resistor 142 so that an equivalent resistance value of the fourth body resistance value R4 and the fourth variable resistor 142 becomes the least common multiple of the first to fourth human body resistance values R1, R2, R3, and R4.

In the present invention, since it is determined whether an electric shock occurs in the human body using a bridge circuit fused with various measurement areas of the human body, it is possible to provide a wearable electric shock recognition device configured to be capable of accurately determining whether an electric shock occurs in the human body, regardless of whether a wearer wears the wearable electric shock recognition device in the direction of the high voltage source and what posture the wearer takes.

DETAILED DESCRIPTION

Figure 1:
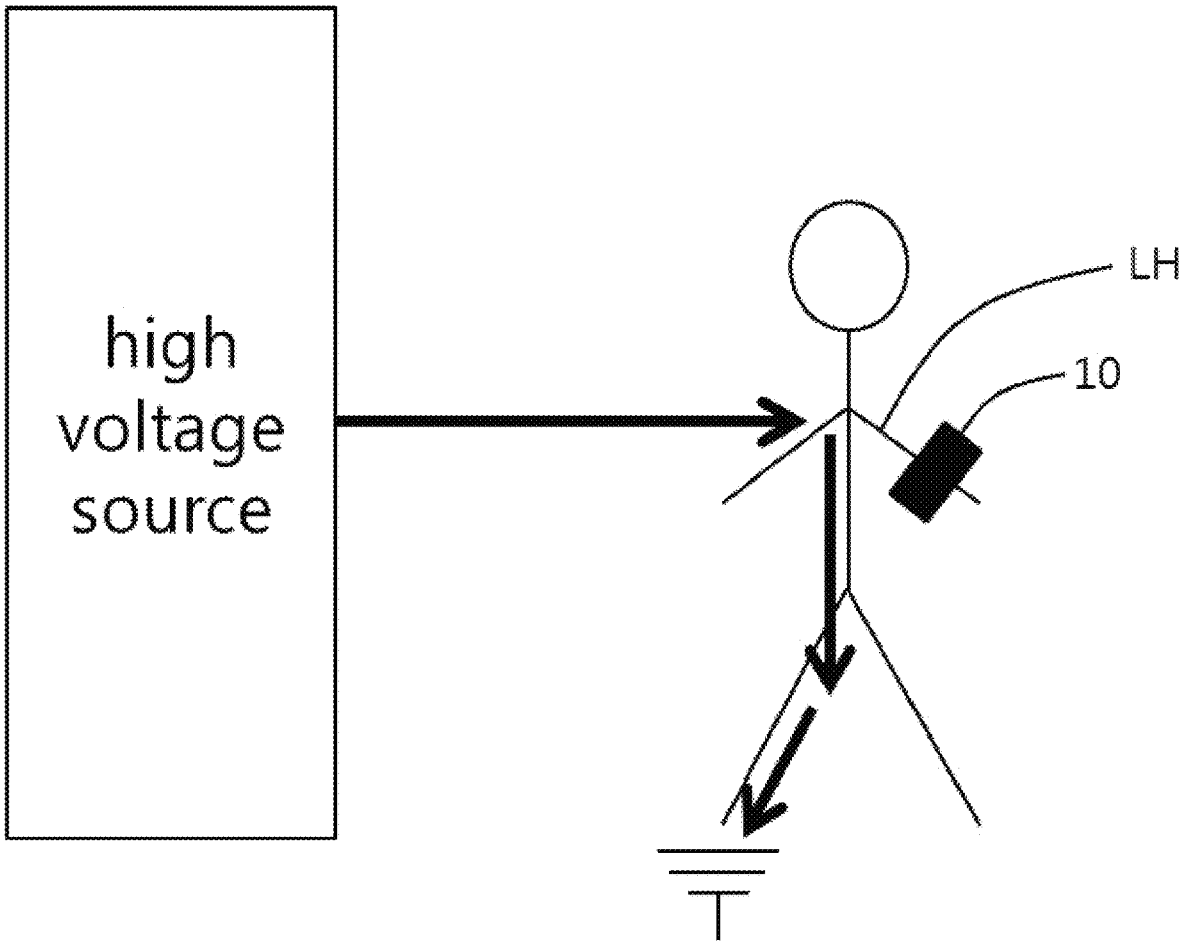
FIG. 1 is a conceptual diagram showing a wearable electric shock warning device according to the related art.

In the present invention, since various modifications may be made and various embodiments may be provided, specific embodiments will be illustrated in the drawings and described in detail in the detailed description. It should be understood that the embodiments do not limit the present invention to specific embodiments, and include all changes, equivalents, or substitutes included in the spirit and scope of the present invention.

Hereinafter, a wearable electric shock recognition device according to an exemplary embodiment of the present invention will be described with reference to FIGS. 2 to 9. Hereinafter, in order to clarify the gist of the present invention, description of matters well known in the related art will be omitted or simplified.

Figure 2:
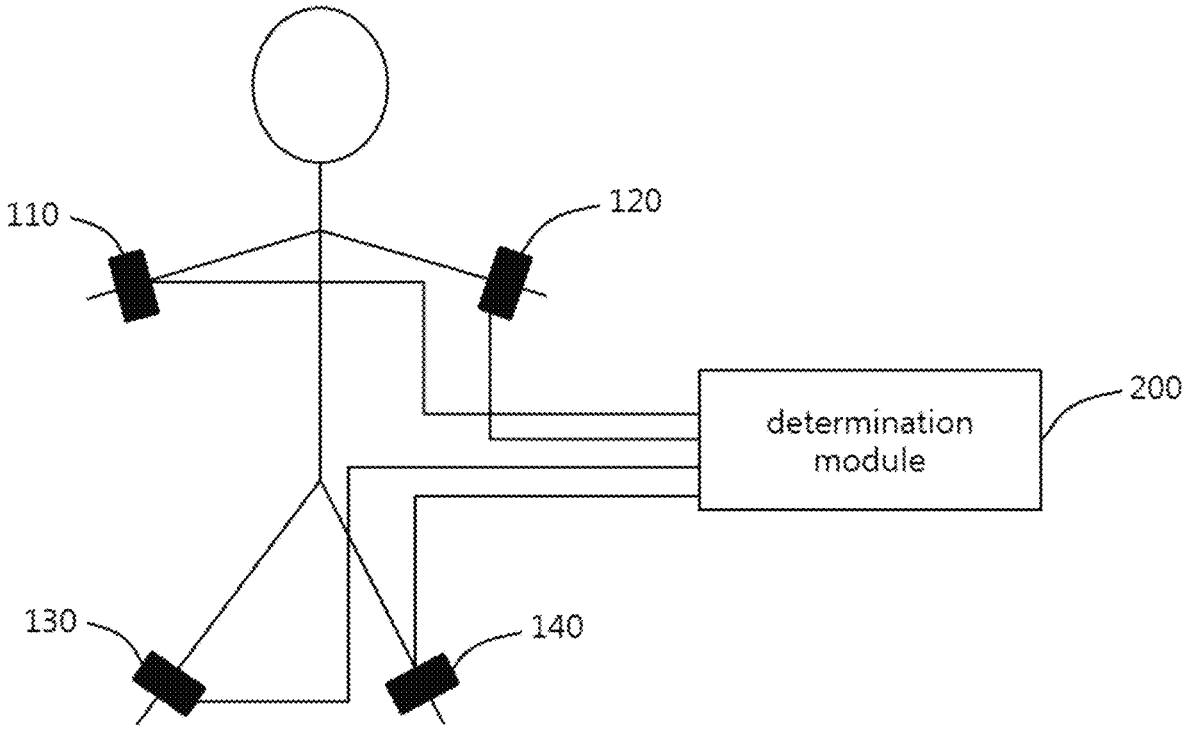
FIG. 2 is a view showing a state in which the wearable electric shock recognition device is worn on a human body according to the present invention.

Referring to FIG. 2, the wearable electric shock recognition device may include a first resistor unit 110, a second resistor unit 120, a third resistor unit 130, a fourth resistor unit 140, and a determination module 200.

The first resistor unit 110 may be fixed to the wrist of the left hand. The second resistor unit 120 may be fixed to the wrist of the right hand. The third resistor unit 130 may be fixed to the ankle of the left foot. The fourth resistor unit 140 may be fixed to the ankle of the right foot. The first resistor unit 110, the second resistor unit 120, the third resistor unit 130, and the fourth resistor unit 140 may be formed in a pad type or a band type in such a manner as to be fixed to the respective corresponding fixing portions.

Figure 3:
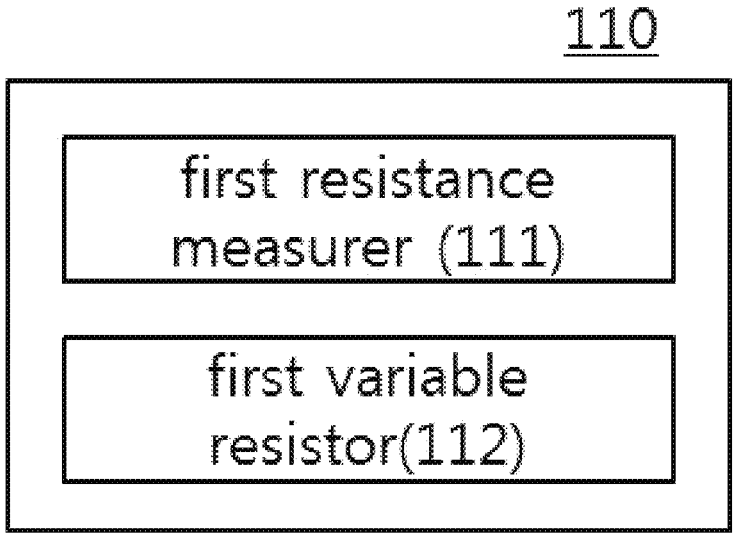
FIG. 3 is a functional block diagram showing a first resistor unit of FIG. 2.

Referring to FIG. 3, the first resistor unit 110 may include a first resistance measurer 111 and a first variable resistor 112.

The first resistance measurer 111 may measure a human body resistance (hereinafter, "first human body resistance") around the wrist of the left hand.

The first variable resistor 112 may be a chip-typed digital variable resistor. The first variable resistor 112 may vary a resistance value by a control signal from a determination module 200.

Figure 4:
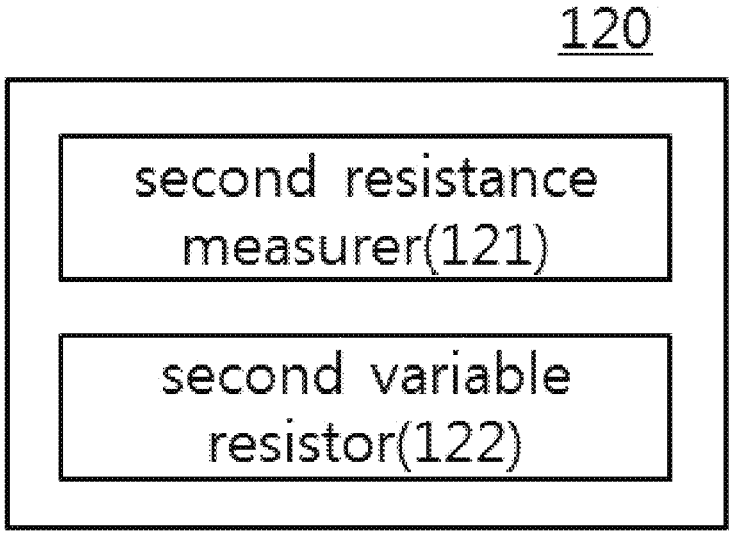
FIG. 4 is a functional block diagram showing a second resistor unit of FIG. 2.

Referring to FIG. 4, the second resistor unit 120 may include a second resistance measurer 121 and a second variable resistor 122.

The second resistance measurer 121 may measure a human body resistance (hereinafter, "second human body resistance") around the wrist of the right hand.

The second variable resistor 122 may be a chip-typed digital variable resistor. The second variable resistor 122 may change a resistance value according to a control signal from the determination module 200.

Figure 5:
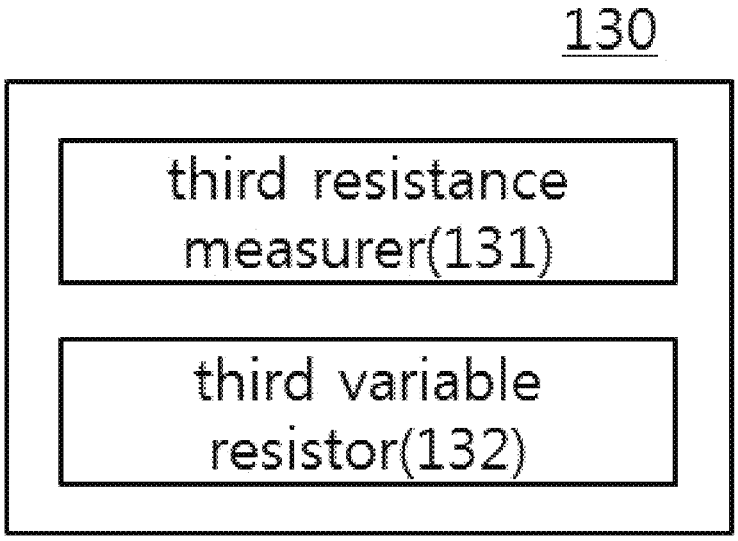
FIG. 5 is a functional block diagram showing a third resistor unit of FIG. 2.

Referring to FIG. 5, the third resistor unit 130 may include a third resistance measurer 131 and a third variable resistor 132.

The third resistance measurer 131 may measure the human body resistance (hereinafter, "third human body resistance") around the ankle of the left foot.

The third variable resistor 132 may be a chip typed digital variable resistor. The third variable resistor 132 may vary a resistance value according to a control signal of the determination module 200.

Figure 6:
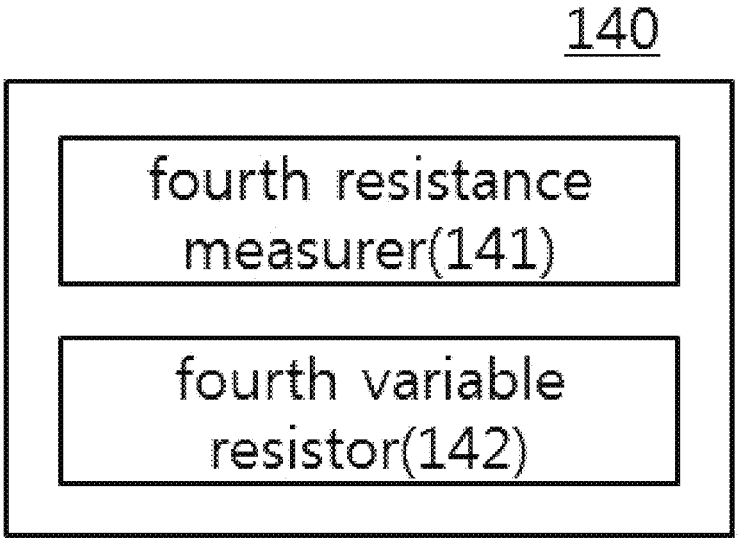
FIG. 6 is a functional block diagram showing a fourth resistor unit of FIG. 2.

Referring to FIG. 6, the fourth resistor unit 140 may include a fourth resistance measurer 141 and a fourth variable resistor 142.

The fourth resistance measurer 141 may measure a human body resistance (hereinafter, "fourth human body resistance") around the ankle of the right foot.

The fourth variable resistor 142 may be a chip typed digital variable resistor. The fourth variable resistor 142 may vary a resistance value by a control signal from the determination module 200.

Figures 7, 8:
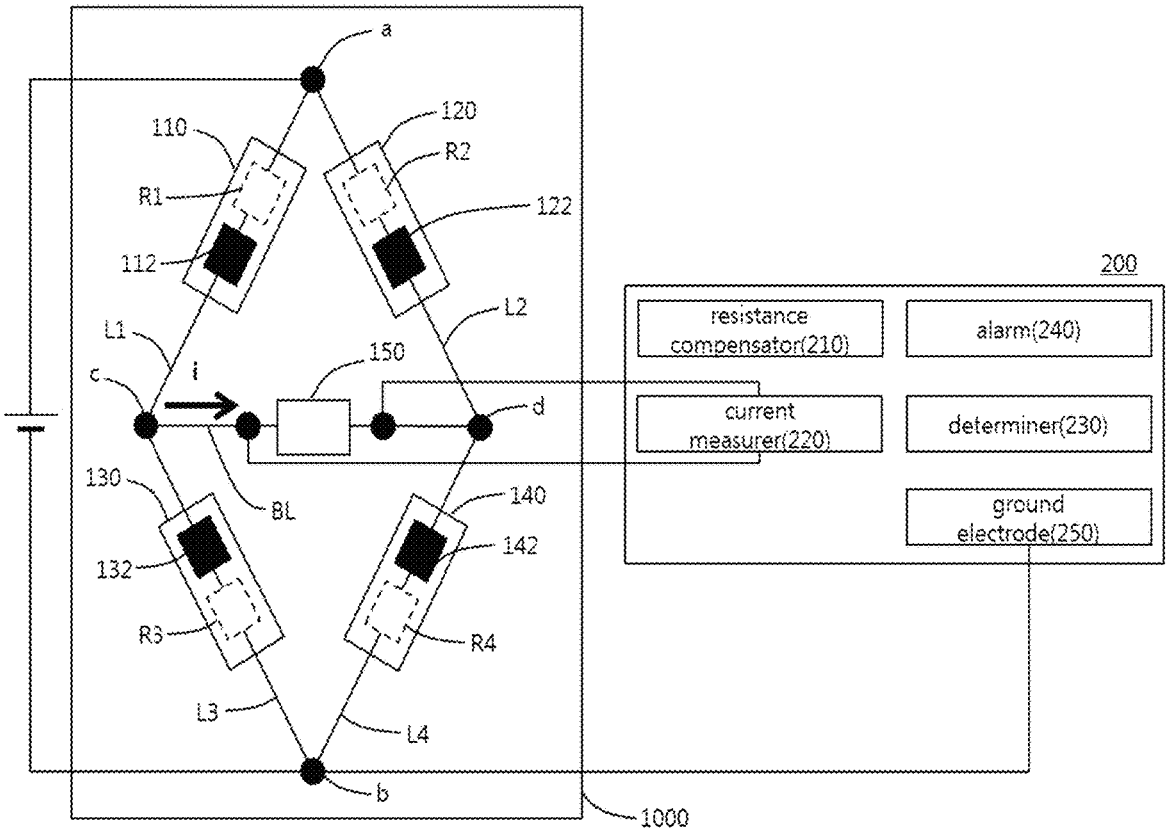
FIG. 7 is a circuit diagram showing a wearable electric shock recognition device of FIG. 2.
FIG. 8 is a diagram showing a method of calculating a resistance compensation value by a resistance compensation unit.

Referring to FIG. 7, the elements for measuring human body resistances may form a bridge circuit 1000. In FIG. 7, R1 may be the first human body resistance value, R2 may be the second human body resistance value, R3 may be the third human body resistance value, and R4 may be the fourth human body resistance value. For convenience of explanation, the first to fourth resistance measurers 111, 121, 131, and 141 are not shown in FIG. 7. The first to fourth variable resistors 112, 122, 132, and 142 and a bridge resistor 150 may be fused with a human body, thereby forming the bridge circuit 1000.

The first variable resistor 112 may be connected in series or in parallel with the first human body resistance value R1 in the area to which the first variable resistor 112 is fixed.

The second variable resistor 122 may be connected in series or in parallel with the second human body resistor R2 in the area to which the second variable resistor 122 is fixed.

The third variable resistor 132 may be connected in series or in parallel with the third human body resistor R3 in the area to which the third variable resistor 132 is attached.

The fourth variable resistor 142 may be connected in series or parallel with the fourth human body resistor R4 in the area to which the fourth variable resistor 142 is attached.

The first variable resistor 112 may be provided in a first line L1 branching from a node a as a starting point. The node a may correspond to an "anode" of the voltage induced to the human body when an electric shock occurs.

The second variable resistor 122 may be installed in a second line L2 branching from a node a as a starting point.

The third variable resistor 132 may be installed in a third line L3 branched from a node b as the starting point. The node b may be an electrode (cathode) corresponding to the ground through which a current induced to the human body is discharged when an electric shock occurs. The node b may be connected to the ground electrode 250 of the determination module 200. The current induced to the human body by the external voltage source may be discharged to the outside of the human body through the node b and the ground electrode 250 of the determination module 200. Accordingly, the bridge circuit 1000 of FIG. 7 may perform a function of recognizing an electric shock to the human body and at the same time perform a function of discharging a current induced in the human body to the outside.

The fourth variable resistor 142 may be installed in a fourth line L4 branched from the node b as a starting point.

A node where the first line L1 and the third line L3 meet may be a node c.

A node where the second line L2 and the fourth line L4 meet may be a node d.

A bridge line BL may be a line connecting the node c and the node d. A bridge resistor R5 may be provided in the bridge line BL. The bridge line BL may be built into the determination module 200.

As is well known, when the node c and the node d are in a balanced state in the bridge circuit 1000 (in other words, when the voltages of the node c and the node d are the same to each other), the current i does not flow in the bridge line BL. Hereinafter, the balanced state of the node c and the node d in the bridge circuit 1000 may have the same meaning as a balanced state of the bridge circuit 1000.

On the contrary, when the node c and the node d are in an unbalanced state in the bridge circuit 1000 (in other words, when the voltages of the node c and the node d are not the same to each other), the current i flows in the bridge line BL. According to the present invention, the bridge circuit 1000 fused with the human body resistance, which is shown in FIG. 7, may be set to be in the balanced state. In addition, whether an electric shock occurs in the human body may be determined by recognizing that the set balanced state is changed into the unbalanced state.

The determination module 200 may include a resistance compensator 210, a current measurer 220, a determiner 230, an alarm 240, and a ground electrode 250. The determination module 200 may be configured with an algorithm operating in a microcontroller unit (MCU).

The determination module 200 may have a resistance compensation mode and an electric shock determination mode. The resistance compensator 210 may perform a resistance compensation mode. The current measurer 220, the determiner 230, and the alarm 240 may perform an electric shock determination mode.

The resistance compensator 210 may collect first to fourth human body resistance values measured by the first to fourth resistance measurers 111, 121, 131, and 141.

In addition, in the resistance compensation mode, the resistance compensator 210 compensates the first to fourth variable resistors 112, 122, 132, and 142 in the bridge circuit 1000 of FIG. 7 so that the bridge circuit 1000 may be in the balanced state.

Hereinafter, with reference to FIG. 8, a method of making the bridge circuit 1000 in the balanced state by the resistance compensator 210 will be described in detail.

First, as shown in FIG. 8, the resistance compensator 210 may obtain the least common multiple of the first to fourth human body resistance values R1, R2, R3, and R4. FIG. 8 shows an example in which the first human body resistance value R1 is 50, the second human body resistance value R2 is 100, the third human body resistance value R3 is 40, and the fourth human body resistance value R4 is 10. In addition, the least common multiple of the first to fourth human body resistance values R1, R2, R3, and R4 is 200. FIG. 8 illustrates a case where each of the human body resistance values R1, R2, R3, and R4 is connected in series with each of the variable resistors 112, 122, 132, and 142. Alternatively, each of the human body resistance values R1, R2, R3, and R4 may be connected in parallel or in a mixture of serial and parallel to each of the variable resistors 112, 122, 132, and 142.

In addition, in the resistance compensation mode, the resistance compensator 210 may control the first variable resistor 112 so that a sum (or equivalent resistance value) of the first body resistance value R1 and the first variable resistor 112 becomes the least common multiple of the first to fourth human body resistance values R1, R2, R3, and R4. FIG. 8 illustrates a case where the first variable resistor 112 is controlled to be 150.

In addition, the resistance compensator 210 may control the second variable resistor 122 so that a sum (or equivalent resistance value) of the second human body resistance value R2 and the second variable resistor 122 becomes the least common multiple of the first to fourth human body resistance values R1, R2, R3, and R4. FIG. 8 illustrates a case in which the second variable resistor 122 is controlled to be 100.

In addition, the resistance compensation unit 210 may control the third variable resistor 132 so that a sum (or equivalent resistance value) of the third human body resistance value R3 and the third variable resistor 132 becomes the least common multiple of the first to fourth human body resistance values R1, R2, R3, and R4. FIG. 8 illustrates a case in which the third variable resistor 132 is controlled to be 160.

In addition, the resistance compensator 210 may control the fourth variable resistor 142 so that a sum (or equivalent resistance value) of the fourth human body resistance value R4 and the fourth variable resistor 142 becomes the least common multiple of the first to fourth human body resistance values R1, R2, R3, and R4. FIG. 8 illustrates a case where the fourth variable resistor 142 is controlled to be 190.

Hereinafter, with reference to FIG. 7, a case where the current measurer 220, the determiner 230 and the alarm 240 operate in the electric shock determination mode will be described.

Referring to FIG. 7, the current measurer 220 may measure the current i flowing through the bridge line BL. A signal processing part for converting an analog current signal into a digital signal may be added to an input terminal (not shown) that provides a current value to the current measurer 220.

The determiner 230 may determine that an electric shock event has occurred when it is determined that the magnitude of the current i flowing through the bridge line BL exceeds a predetermined electric shock threshold. The determiner 230 may determine that no electric shock event has occurred when the magnitude of the current i flowing through the bridge line BL is less than or equal to a predetermined electric shock threshold.

The alarm 240 may provide an alarm sound when the determiner 230 determines that an electric shock event has occurred. In addition, when the determiner 230 determines that an electric shock event has occurred, the alarm 240 may notify the occurrence of the electric shock event remotely using a wireless communication network. Herein, a control server located in remote areas may turn off a circuit breaker provided in the high voltage source, thereby removing a risk of electric shock.

The ground electrode 250 may provide a reference potential of the determination module 200. The ground electrode 250 is connected to the node b, so that current of the human body may be discharged through the ground electrode 250, thereby reducing the risk of electric shock.

Hereinafter, an operation of the wearable electric shock recognition device will be described with reference to FIG. 9. The above configuration may be more clarified by the following description. Hereinafter, description of the above-described matters will be omitted or simplified.

First, the respective first to fourth resistance measurers 111, 121, 131, and 141 may measure the human body resistance at the respective corresponding measurement portions (S1).

In addition, the resistance compensator 210 may calculate a resistance compensation value at each measurement position (S2). FIG. 8 illustrates a case where the resistance compensation value corresponding to the left wrist is 150, the resistance compensation value corresponding to the right wrist is 100, the resistance compensation value corresponding to the left ankle is 160, and the resistance compensation value corresponding to the right ankle is 190. The first resistance compensation value is a value obtained by subtracting a human body resistance value measured by the first resistance measurer 111 from the least common multiple of the human body resistance values measured by the first to fourth resistance measurers 111, 121, 131, and 141. The second resistance compensation value is a value obtained by subtracting a human body resistance value measured by the second resistance measuring unit 121 from the least common multiple of the human body resistance values measured by the first to fourth resistance measuring units 111, 121, 131, and 141. The third resistance compensation value is a value obtained by subtracting a human body resistance value measured by the third resistance measurement unit 131 from the least common multiple of the human body resistance values measured by the first to fourth resistance measurement units 111, 121, 131, and 141. The fourth resistance compensation value is a value obtained by subtracting a human body resistance value measured by the fourth resistance measurement unit 141 from the least common multiple of the human body resistance values measured by the first to fourth resistance measurement units 111, 121, 131, and 141.

In addition, the resistance compensator 210 may control the variable resistor so that the variable resistor has the calculated resistance compensation value (S3). Herein, the resistance compensator 210 may control the first variable resistor 112 so that the first variable resistor 112 has a first resistance compensation value. In addition, the resistance compensator 210 may control the second variable resistor 122 so that the second variable resistor 122 has a second resistance compensation value. In addition, the resistance compensator 210 may control the third variable resistor 132 so that the third variable resistor 132 has a third resistance compensation value. In addition, the resistance compensator 210 may control the fourth variable resistor 142 so that the fourth variable resistor 142 has a fourth resistance compensation value. S1 to S3 correspond to the resistance compensation mode.

In addition, the current measurer 220 may detect a current i in the bridge line BL (S4).

In addition, the determiner 230 may determine whether the current i in the bridge line BL exceeds an electric shock threshold (S5). In S5, when it is determined that the current i in the bridge line BL exceeds the electric shock threshold, the alarm 240 may provide an alarm sound (S6). In contrast, when it is determined in S5 that the current i in the bridge line BL does not exceed the electric shock threshold, the process may be returned to S4. S4 to S6 correspond to the electric shock determination mode.

Figure 9:
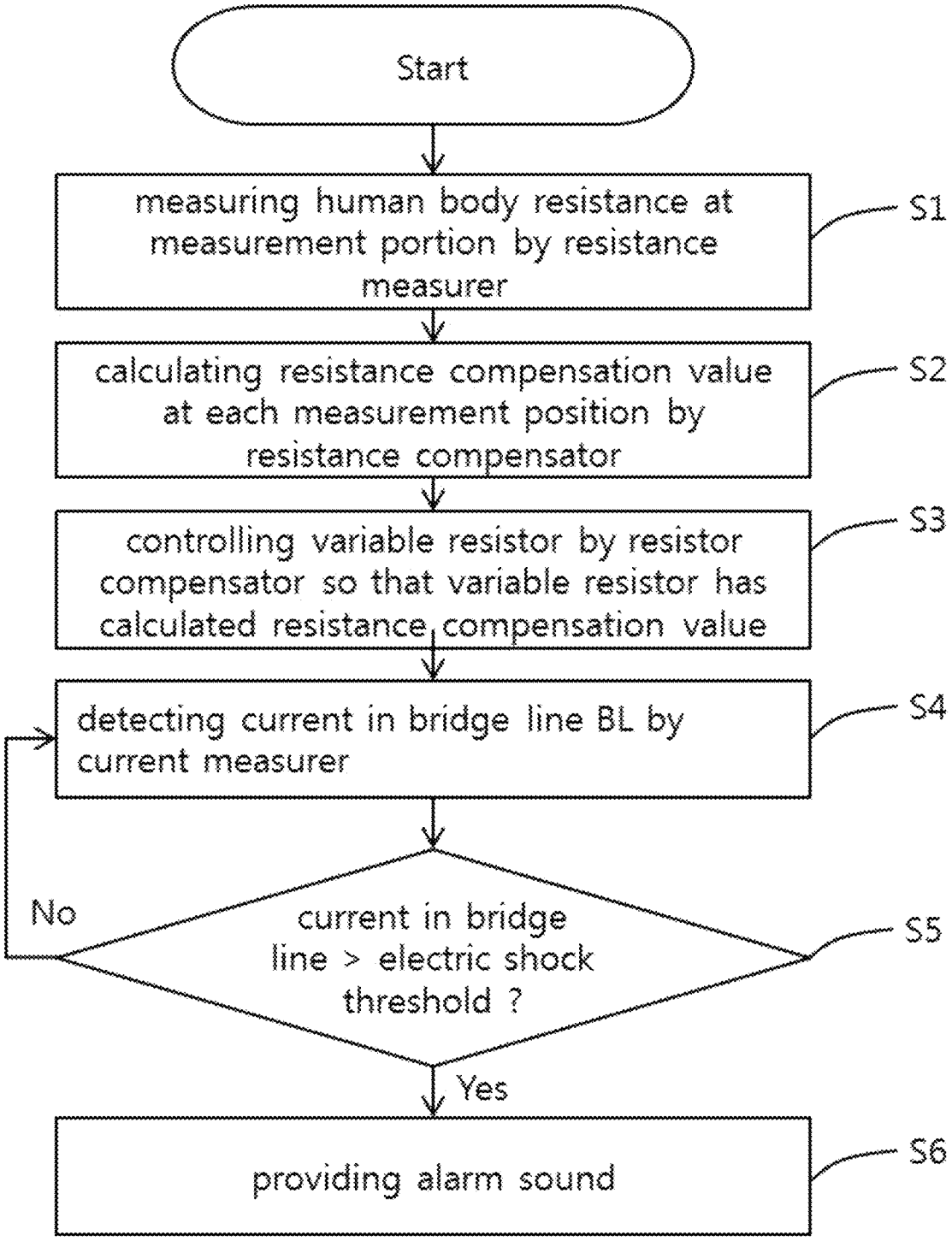
FIG. 9 is a flowchart showing an operation of a wearable electric shock recognition device of FIG. 2.

The process of FIG. 9 may be implemented in whole and in part. In addition, when some are implemented, other may be modified.

The invention claimed is:

1. A wearable electric shock recognition device, comprising:

first to fourth variable resistors and a bridge resistor forming a bridge circuit;

a resistance compensator compensating the first to fourth variable resistors in the bridge circuit so that the bridge circuit is in a balanced state;

a current measurer that detects a current flowing through a bridge line; and a determiner determines that an electric shock event has occurred when a magnitude of the current flowing through the bridge line exceeds a predetermined electric shock threshold, wherein the resistance compensator collects first to fourth human body resistance values measured by first to fourth resistance measurers, the resistance compensator controls the first variable resistor so that an equivalent resistance value of the first body resistance value and the first variable resistor becomes the least common multiple of the first to fourth human body resistance values, the resistance compensator controls the second variable resistor so that an equivalent resistance value of the second body resistance value and the second variable resistor becomes the least common multiple of the first to fourth human body resistance values, the resistance compensator controls the third variable resistor so that an equivalent resistance value of the third body resistance value and the third variable resistor becomes the least common multiple of the first to fourth human body resistance values, and the resistance compensator controls the fourth variable resistor so that an equivalent resistance value of the fourth body resistance value and the fourth variable resistor becomes the least common multiple of the first to fourth human body resistance values.

2. The device of claim 1, wherein the first to fourth variable resistors are digital variable resistors.

* * * * *